US011353033B2

(12) United States Patent
Hsieh et al.

(10) Patent No.: US 11,353,033 B2
(45) Date of Patent: Jun. 7, 2022

(54) CEILING FAN

(71) Applicant: Hoteck Inc., Taichung (TW)

(72) Inventors: Lung-Fa Hsieh, Taichung (TW); Yu-Chen Hsieh, Taichung (TW)

(73) Assignee: Hoteck Inc., Taichung (TW)

( * ) Notice: Subject to any disclaimer, the term of this patent is extended or adjusted under 35 U.S.C. 154(b) by 46 days.

(21) Appl. No.: 16/917,455

(22) Filed: Jun. 30, 2020

(65) Prior Publication Data

US 2021/0222698 A1 Jul. 22, 2021

(30) Foreign Application Priority Data

Jan. 20, 2020 (TW) ..... 109200844

(51) Int. Cl.

| | |
|---|---|
| ***F04D 27/00*** | (2006.01) |
| ***F04D 25/08*** | (2006.01) |
| ***F04D 29/52*** | (2006.01) |
| ***F04D 29/34*** | (2006.01) |
| ***F04D 19/00*** | (2006.01) |

(52) U.S. Cl.

CPC ..... *F04D 27/004* (2013.01); *F04D 19/002* (2013.01); *F04D 25/088* (2013.01); *F04D 29/34* (2013.01); *F04D 29/522* (2013.01); *F05B 2260/232* (2013.01); *F05B 2270/101* (2013.01); *F05B 2270/303* (2013.01); *F05B 2270/325* (2013.01); *F05B 2270/804* (2013.01)

(58) Field of Classification Search

CPC .... F04D 27/004; F04D 19/002; F04D 25/088; F04D 29/34; F04D 29/522

See application file for complete search history.

(56) References Cited

U.S. PATENT DOCUMENTS

| | | | | |
|---|---|---|---|---|
| 2011/0274561 | A1* | 11/2011 | Kobayashi | F04D 27/004 417/14 |
| 2017/0205105 | A1* | 7/2017 | Adam | F04D 27/004 |
| 2017/0370366 | A1* | 12/2017 | Johnson | F04D 25/088 |
| 2021/0048041 | A1* | 2/2021 | Gorali | F04D 29/646 |

FOREIGN PATENT DOCUMENTS

| | | | | |
|---|---|---|---|---|
| WO | WO-2019180692 A1 * | 9/2019 | | F16M 13/027 |

* cited by examiner

*Primary Examiner* — Patrick Hamo
(74) *Attorney, Agent, or Firm* — Polsinelli PC

(57) ABSTRACT

A ceiling fan includes a fan body, a sensing unit and a control unit. The fan body includes a base seat, a plurality of fan blades mounted to the base seat, and a motor mounted to the base seat for driving rotation of the fan blades about the base seat. The sensing unit includes an outer casing, a room temperature sensor, and a body temperature sensor. The control unit is mounted to the fan body, in communication with the room temperature sensor, the body temperature sensor and the motor, and operable to adjust a rotational speed of the fan blades by controlling the motor according to a room temperature and a body temperature respectively sensed by the room temperature sensor and the body temperature sensor.

9 Claims, 6 Drawing Sheets

CEILING FAN

CROSS-REFERENCE TO RELATED APPLICATION

This application claims priority of Taiwanese Utility Model Patent Application No. 109200844, filed on Jan. 20, 2020.

FIELD

The disclosure relates to a ceiling fan, more particularly to a ceiling fan with a sensing unit.

BACKGROUND

A traditional ceiling fan speeds up circulation of air in a room and can help make cooling or heating of a room more effective when paired with air conditioning.

A conventional smart ceiling fan device has a temperature sensor mounted therein to switch on or off the conventional ceiling fan device according to the room temperature to ensure that the room temperature is kept within a range. However, a cost of the conventional smart ceiling fan is increased due to the inclusion of the temperature sensor, which might make the conventional smart ceiling fan device less enticing for consumers. Furthermore, if the consumer already owns a traditional ceiling fan and wishes to add temperature sensing capabilities, the consumer would need to replace the entire traditional ceiling fan with the conventional smart ceiling fan device.

SUMMARY

Therefore, the object of the disclosure is to provide a ceiling fan with a modular sensing unit.

According to the disclosure, a ceiling fan includes a fan body, a sensing unit and a control unit.

The fan body includes a base seat, a plurality of fan blades mounted to the base seat, and a motor mounted to the base seat for driving rotation of the fan blades about the base seat.

The sensing unit includes an outer casing, a room temperature sensor disposed in the outer casing, and a body temperature sensor disposed in the outer casing.

The control unit is mounted to the fan body, in communication with the room temperature sensor, the body temperature sensor and the motor, and operable to adjust a rotational speed of the fan blades by controlling the motor according to a room temperature and a body temperature respectively sensed by the room temperature sensor and the body temperature sensor.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
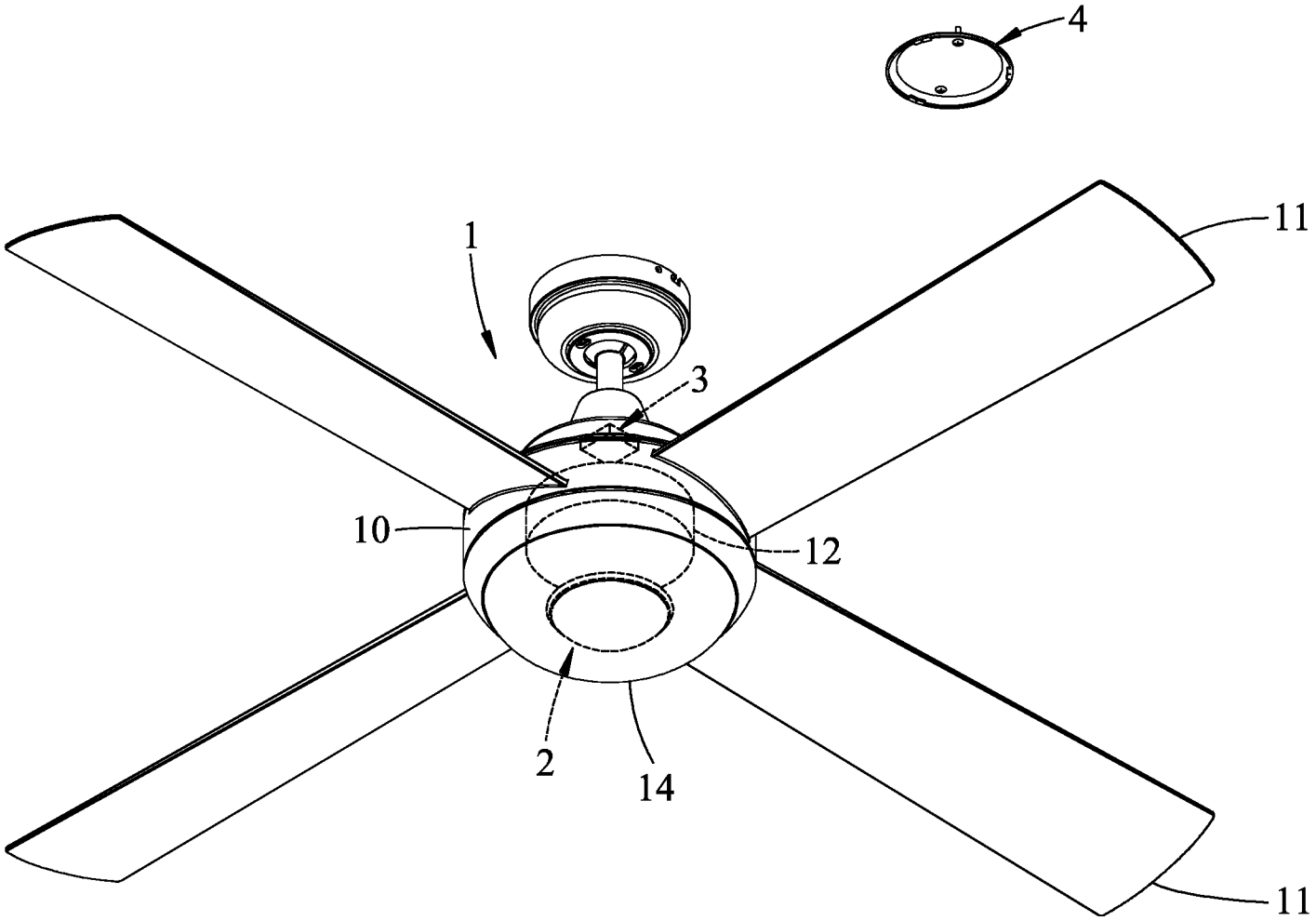
FIG. 1 is a perspective view of an embodiment of a ceiling fan according to the disclosure.
Figure 2:
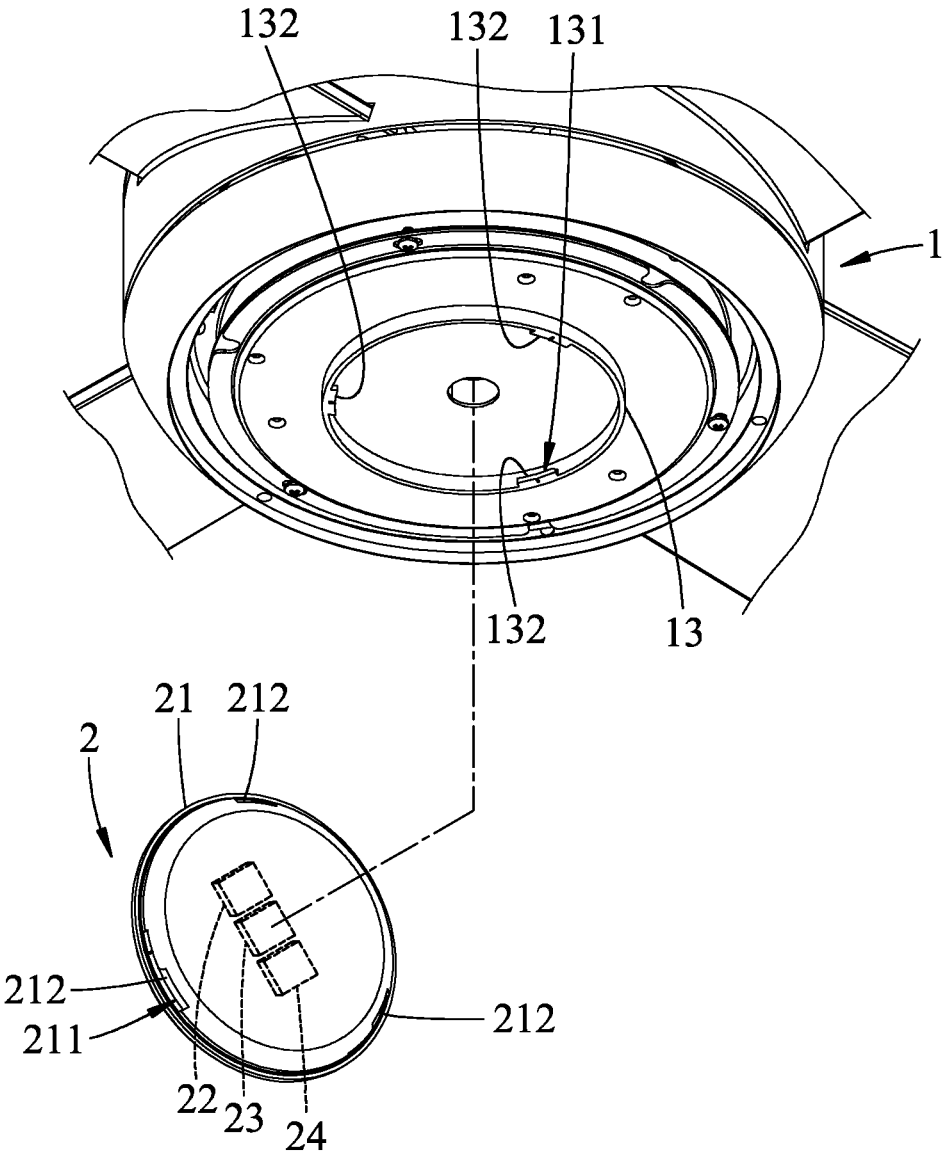
FIG. 2 is a partly exploded fragmentary perspective view, illustrating structure of a first mounting frame and a sensing unit of the embodiment.
Figure 3:
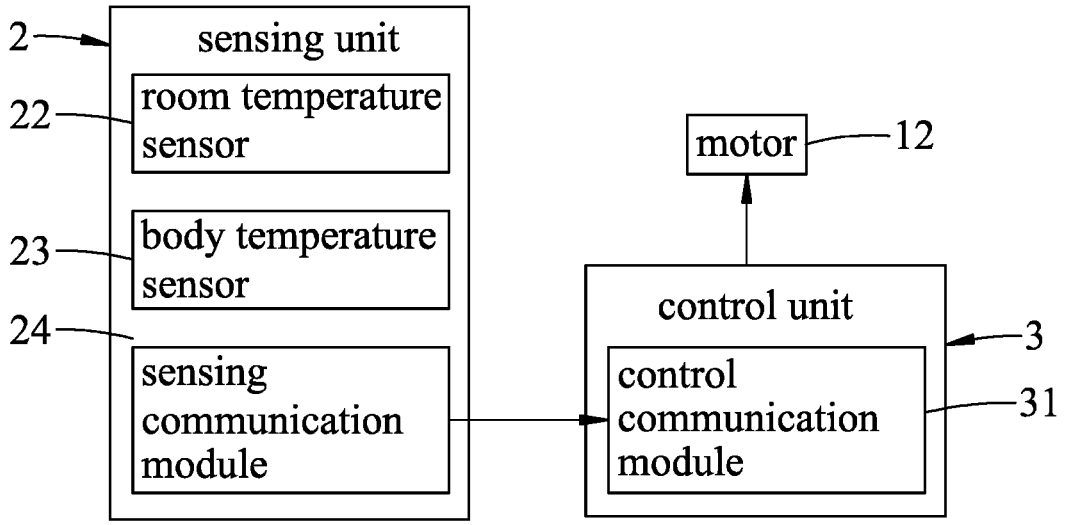
FIG. 3 is a block diagram illustrating connections in the embodiment.

Referring to FIGS. 1 to 3, an embodiment of a ceiling fan according to the disclosure includes a fan body 1, a sensing unit 2, a control unit 3 and a second mounting frame 4. The sensing unit 2 is removably mounted to one of the fan body 1 and the second mounting frame 4.

The fan body 1 includes a base seat 10, a plurality of fan blades 11 mounted to the base seat 10, a motor 12 mounted to the base seat 10 for driving rotation of the fan blades 11 about the base seat 10, a first mounting frame 13 mounted to the base seat 10, and a cover 14 mounted removably to the first mounting frame 13.

The sensing unit 2 includes an outer casing 21, a room temperature sensor 22 disposed in the outer casing 21, a body temperature sensor 23 disposed in the outer casing 21, and a sensing communication module 24 for transmitting a temperature signal including information about a room temperature and a body temperature respectively sensed by the room temperature sensor 22 and the body temperature sensor 23. In this embodiment, the body temperature sensor 23 is an infrared sensor.

The control unit 3 is mounted to the fan body 1, in communication with the room temperature sensor 22, the body temperature sensor 23 and the motor 12, and operable to adjust a rotational speed of the fan blades 11 by controlling the motor 12 according to the room temperature and the body temperature respectively sensed by the room temperature sensor 22 and the body temperature sensor 23. The control unit 3 includes a control communication module 31 in communication with the sensing communication module 24 for receiving the temperature signal. The control communication module 31 and the sensing communication module 24 may be in communication via wire or wirelessly. In this embodiment, the control communication module 31 and the sensing communication module 24 are in communication via Bluetooth.

The second mounting frame 4 is spaced apart from the fan body 1. Specifically, the second mounting frame 4 is disposed within a predetermined communicable distance away from the fan body 1. When the control communication module 31 and the sensing communication module 24 are in wired communication, electrical wiring is taken into account while installing the second mounting frame 4. When the control communication module 31 and the sensing communication module 24 are in wireless communication, the predetermined communicable distance depends on a range of the wireless technology used.

Figure 4:
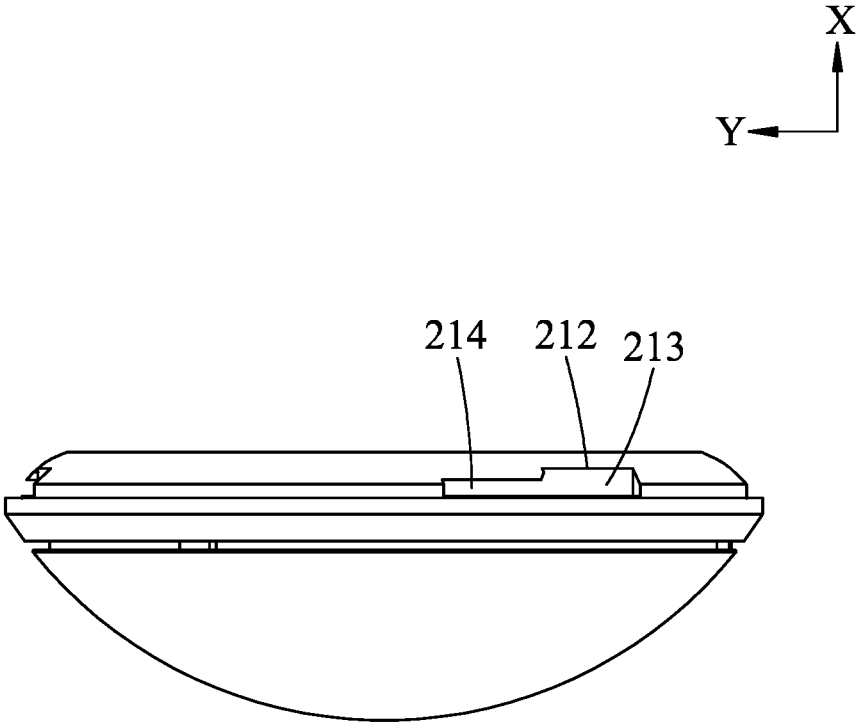
FIG. 4 is a side view of the sensing unit.
Figure 5:
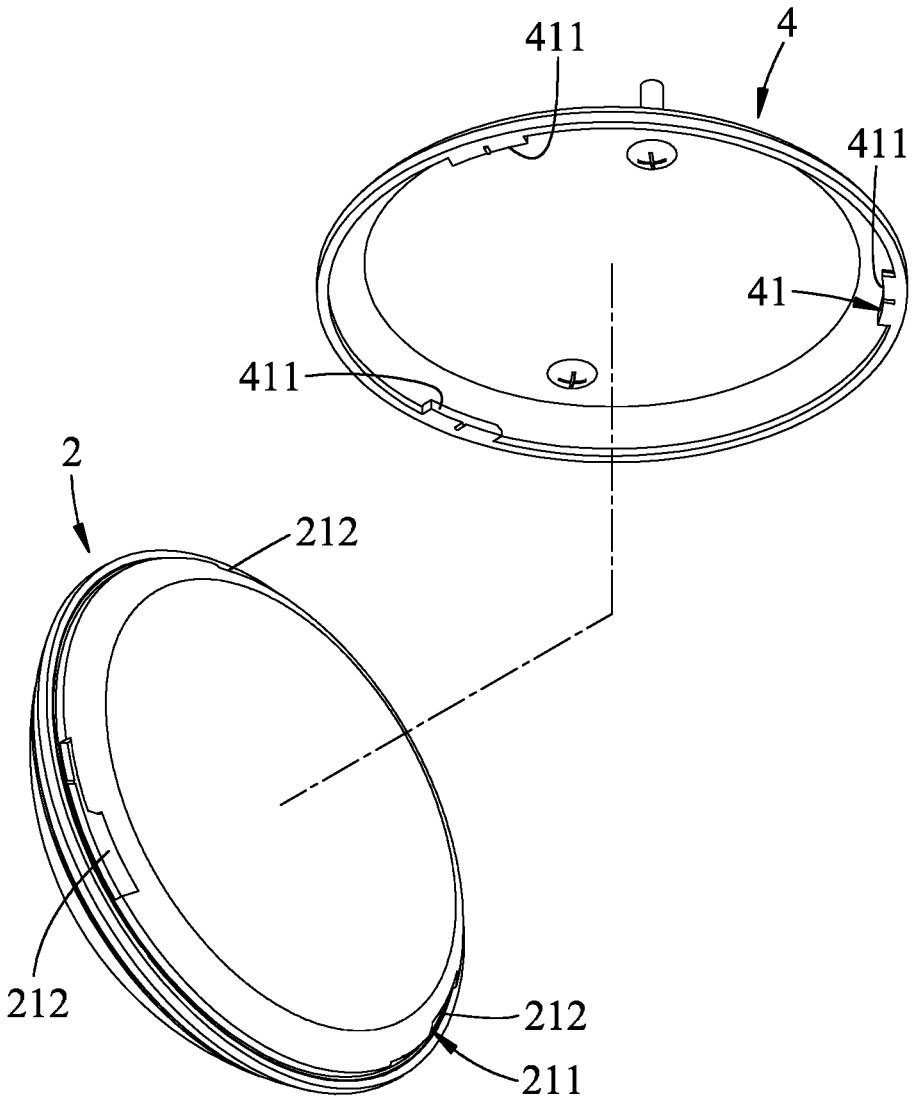
FIG. 5 is a partly exploded perspective view of a second mounting frame and the sensing unit of the embodiment.

Referring to FIGS. 2, 4, and 5, the first mounting frame 13 has a first mounting portion 131, the second mounting frame 4 includes a second mounting portion 41, and the outer casing 21 of the sensing unit 2 has a coupling portion 211 removably coupled with one of the first mounting portions 131 of the first mounting frame 13 and the second mounting portion 41 of the second mounting frame 4. When the outer casing 21 is mounted to the first mounting frame 13, the cover 14 covers the sensing unit 2 to protect the sensing unit 2 from physical damage.

The first mounting portion 131 and the second mounting portion 41 has substantially the same structure. Specifically, the first mounting portion 131 of the first mounting frame 13 has at least one protruding block 132 and the second mounting portion 41 of the second mounting frame 4 has at least one protruding block 411. The coupling portion 211 of the outer casing 21 has at least one groove 212 having a guiding section 213 that extends in a guiding direction (X), and a coupling section 214 that extends from the guiding section 213 in a coupling direction (Y) being transverse to the guiding direction (X). The at least one protruding block 132, 411 of said one of the first mounting portion 131 of the first mounting frame 13 and the second mounting portion 41 of the second mounting frame 4 is inserted into and engages the coupling section 214 of the at least one groove 212 of the coupling portion 211 of the outer casing 21 through the guiding section 213 of the at least one groove 212.

In this embodiment, the quantity of each of the protruding blocks 132, 411, and the groove 212 is three. However, the quantity of each of the protruding blocks 132, 411, and the groove 212 may be one, two or more than four in other embodiments, and is not limited to the disclosure herein. The guiding direction (X) is a substantially vertical direction. The coupling section 214 of the at least one groove 212 is curved, and the coupling direction (Y) is a rotational direction that is perpendicular to the guiding direction (X). Specifically, in this embodiment, the coupling section 214 is arc-shaped, each of the first and second mounting portions 131, 41 is annular, and the coupling direction (Y) is circumferential.

In certain embodiments, the second mounting frame 4 may be omitted so that the coupling portion 211 of the outer casing 21 is removably coupled with the first mounting portion 131. Specifically, the at least one protruding block 132 of the first mounting portion 131 of the first mounting frame 13 is inserted into and engages the coupling section 214 of the at least one groove 212 of the coupling portion 211 of the outer casing 21 through the guiding section 213 of the at least one groove 212. In other embodiments, the ceiling fan may include a plurality of second mounting frames 4.

In certain embodiments, one of the first mounting portion 131 of the first mounting frame 13 and the coupling portion 211 of the outer casing 21 has at least one protruding block, and the other one of the first mounting portion 131 of the first mounting frame 13 and the coupling portion 211 of the outer casing 21 has at least one groove. That is to say, the first mounting portion 131 may have the at least one groove and the coupling portion 211 may have the at least one protruding block.

Referring to FIGS. 1 to 3, the ceiling fan of this embodiment is exemplified as being used in a stage area of a performance venue or an entrance area of a mall. Temperature change is more drastic in the stage area and entrance area due to larger movement of people, and therefore the ceiling fan may be installed proximal to these areas.

In this scenario, the sensing unit 2, which is currently mounted to the fan body 1, may sense the room temperature and the body temperature of a crowd of people at a respective area to provide information to the control unit 3 so that the control unit 3 may adjust the rotational speed of the fan blades 11 accordingly.

Figure 6:
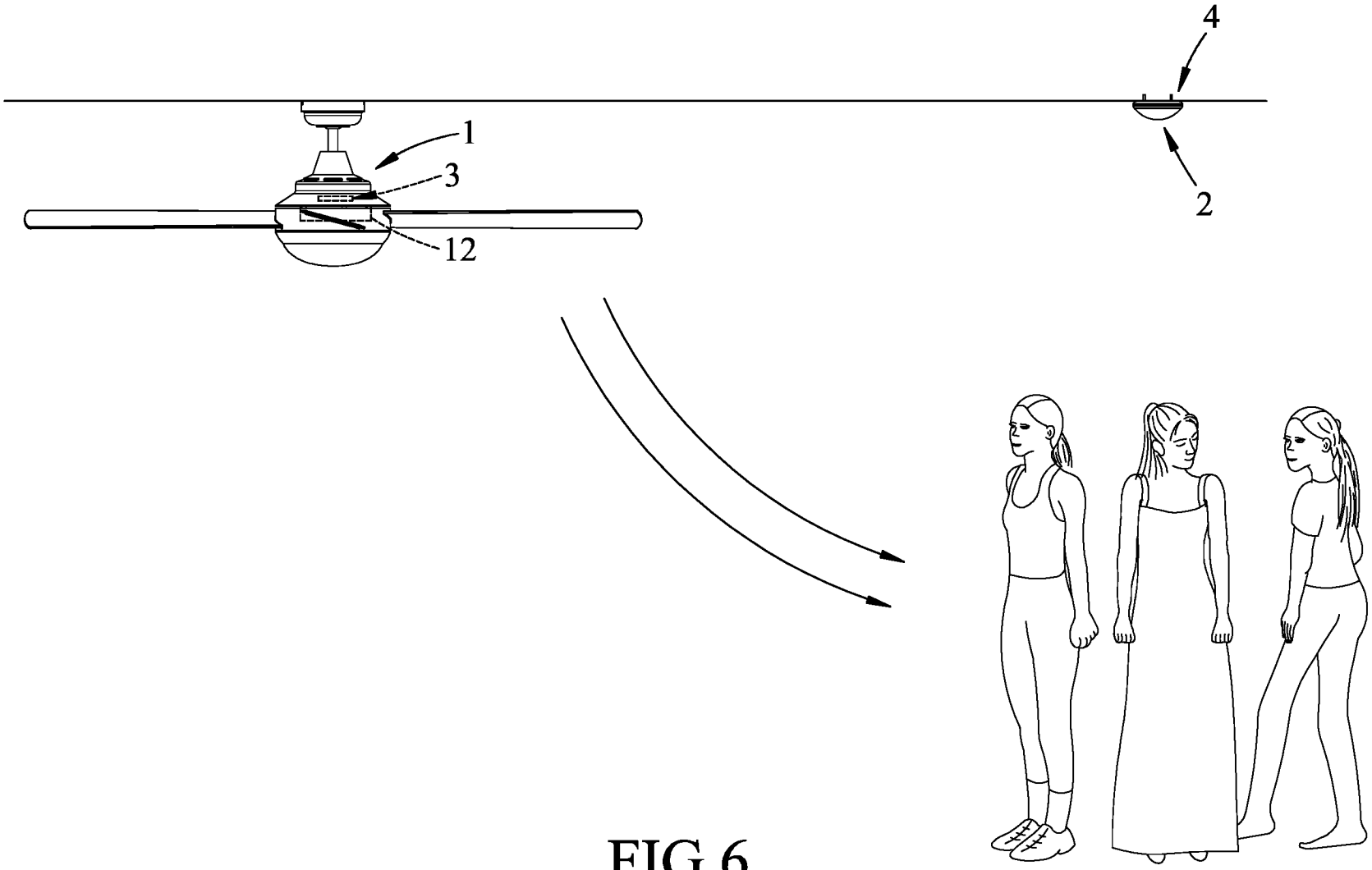
FIG. 6 is a schematic view illustrating an exemplary application of the embodiment.

Referring to FIG. 6, in another scenario, as the ceiling fan is designed to generate sideways airflow, the sensing unit 2 may instead be mounted to the second mounting frame 4 which is installed directly above an area to be cooled to detect the room temperature and body temperature of people in said area, and the fan body 1 is installed to the side of said area to blow air into said area.

In certain embodiments, the number of the second mounting frame 4 is variable depending on requirement. For example, a plurality of the second mounting frames 4 may be installed around the fan body 1, and the sensing unit 2 may be moved to be mounted to a different one of the second mounting frames 4 depending on requirement.

The benefits of the ceiling fan of the disclosure are as follows:

1. Because of the modularization of the sensing unit 2, when purchasing a ceiling fan, a consumer can choose to buy the ceiling fan not including the sensing unit 2, with the possibility of adding on the sensing unit 2 in the future.

2. Due to provision of the at least one second mounting frame 4, the sensing unit 2 may be mounted in at least one other location apart from the fan body 1 to conduct more precise sensing in certain situations.

3. The first and second mounting portions 131, 41 and the coupling portion 211 correspondingly including protruding blocks and grooves allows the sensing unit 2 to be mounted to one of the first and second mounting frames 13, 4 using a simple structure.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A ceiling fan comprising:

a fan body including a base seat, a plurality of fan blades that are mounted to the base seat, and a motor that is mounted to said base seat for driving rotation of said fan blades about said base seat;

a sensing unit including an outer casing, a room temperature sensor that is disposed in said outer casing, and a body temperature sensor that is disposed in said outer casing;

a control unit mounted to said fan body, being in communication with said room temperature sensor, said body temperature sensor and said motor, and operable to adjust a rotational speed of said fan blades by controlling said motor according to a room temperature and a body temperature respectively sensed by said room temperature sensor and said body temperature sensor;

wherein said ceiling fan further comprises a first mounting frame spaced apart from said fan body and having a first mounting portion;

wherein said fan body further includes a second mounting frame mounted to said base seat and having a second mounting portion; and wherein said outer casing of said sensing unit has a coupling portion removably coupled with one of said first mounting portion of said first mounting frame and said second mounting portion of said second mounting frame.

2. The ceiling fan as claimed in claim 1, wherein:

said outer casing of said sensing unit has a coupling portion that is removably coupled with said first mounting portion of said first mounting frame.

3. The ceiling fan as claimed in claim 2, wherein one of said first mounting portion of the first mounting frame and said coupling portion of said outer casing has at least one protruding block, and the other one of said first mounting portion of the first mounting frame and said coupling portion of said outer casing has at least one groove.

4. The ceiling fan as claimed in claim 3, wherein:

said first mounting portion of the first mounting frame has at least one protruding block;

said coupling portion of said outer casing has at least one groove having a guiding section that extends in a guiding direction, and a coupling section that extends from said guiding section in a coupling direction which is transverse to said guiding direction, said at least one protruding block of said first mounting portion of the first mounting frame being inserted into and engaging said coupling section of said at least one groove of said coupling portion of said outer casing through said guiding section of said at least one groove.

5. The ceiling fan as claimed in claim 4, wherein:

said guiding direction is a substantially vertical direction; and said coupling section of said at least one groove is curved, said coupling direction being a rotational direction that is perpendicular to said guiding direction.

6. The ceiling fan as claimed in claim 2, wherein said fan body further includes a cover mounted removably to said first mounting frame and covering said sensing unit.

7. The ceiling fan as claimed in claim 1, wherein:

said first mounting portion of the first mounting frame has at least one protruding block;

said second mounting portion of the second mounting frame has at least one protruding block;

said coupling portion of said outer casing has at least one groove having a guiding section that extends in a guiding direction, and a coupling section that extends from said guiding section in a coupling direction being transverse to said guiding direction; and said at least one protruding block of said one of said first mounting portion of the first mounting frame and said second mounting portion of said second mounting frame is inserted into and engages said coupling section of said at least one groove of said coupling portion of said outer casing through said guiding section of said at least one groove.

8. The ceiling fan as claimed in claim 1, wherein said sensing unit further includes a sensing communication module for transmitting a temperature signal including information about the room temperature and the body temperature, said control unit including a control communication module that is in communication with said sensing communication module for receiving said temperature signal.

9. The ceiling fan as claimed in claim 1, wherein said body temperature sensor is an infrared sensor.

* * * * *